US008757770B2

(12) United States Patent
Suzuki et al.

(10) Patent No.: US 8,757,770 B2
(45) Date of Patent: Jun. 24, 2014

(54) IMAGE FORMING APPARATUS

(71) Applicant: Brother Kogyo Kabushiki Kaisha, Aichi-Ken (JP)

(72) Inventors: Yusuke Suzuki, Anjo (JP); Keiji Kura, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 0 days.

(21) Appl. No.: 13/759,145

(22) Filed: Feb. 5, 2013

(65) Prior Publication Data

US 2013/0257982 A1 Oct. 3, 2013

(30) Foreign Application Priority Data

Mar. 29, 2012 (JP) ..... 2012-075762

(51) Int. Cl.
*B41J 2/145* (2006.01)
*B41J 2/15* (2006.01)

(52) U.S. Cl.
USPC ..... 347/37; 347/40; 347/42

(58) Field of Classification Search
USPC ..... 347/9–12, 15, 16, 20, 37, 40–43, 347/49–50, 104
See application file for complete search history.

(56) References Cited

U.S. PATENT DOCUMENTS

| | | | | |
|---|---|---|---|---|
| 5,640,183 | A * | 6/1997 | Hackleman | 347/40 |
| 6,896,354 | B1 | 5/2005 | Uchisako et al. | |
| 6,964,468 | B2 * | 11/2005 | Kitahara et al. | 347/42 |
| 2005/0007413 | A1 | 1/2005 | Uchisako et al. | |

FOREIGN PATENT DOCUMENTS

| | | |
|---|---|---|
| JP | 2001-105593 | 4/2001 |
| JP | 2002-205389 | 7/2002 |
| JP | 2004-351676 | 12/2004 |

* cited by examiner

*Primary Examiner* — Thinh Nguyen
(74) *Attorney, Agent, or Firm* — Frommer Lawrence & Haug LLP

(57) ABSTRACT

An image forming apparatus includes: a transport section including a first transport section configured to transport the recording medium in a first direction having a component of a downward direction in a vertical direction, a second transport section configured to transport the recording medium in a second direction having a component of an upward direction in the vertical direction, and a third transport section configured to connect the first transport section and the second transport section; a first head provided to face the first transport section and includes a plurality of first nozzles formed in different positions in the vertical direction; a second head provided to face the second transport section and includes a plurality of second nozzles formed in different positions in the vertical direction; and a control device configured to control the transport section, the first head, and the second head.

9 Claims, 11 Drawing Sheets

IMAGE FORMING APPARATUS

CROSS REFERENCE TO RELATED APPLICATION

The present application claims priority from Japanese Patent Application No. 2012-075762, filed on Mar. 29, 2012, the disclosure of which is incorporated herein by reference in its entirety.

BACKGROUND OF THE INVENTION

1. Field of the Invention

The present invention relates to an image forming apparatus which jets liquid droplets to form an image.

2. Description of the Related Art

There has been conventionally known an image forming apparatus which includes a head provided with a plurality of nozzles for jetting liquid droplets and which forms an image on a recording medium by jetting the liquid droplets from the nozzles in a state that a nozzle-formation surface of the head in which the nozzles are formed faces a surface of the recording medium on which the image is to be formed.

The image forming apparatus as described above is configured to include a tank in which liquid is stored and a channel which communicates the tank and the head as a means for supplying the liquid to the head, so that the liquid in the tank is supplied to the nozzles of the head. In order to prevent the liquid from leaking from the nozzles when image formation is not performed, the image forming apparatus is configured such that a liquid surface of the tank is lower than liquid surfaces of the nozzles and negative pressure is applied to the liquid surfaces of the nozzles due to difference between the liquid surface of the tank and the liquid surfaces of the nozzles (water head difference).

In this type of image forming apparatus, a transport path of the recording medium extending in a horizontal direction is included therein, the head is mounted above the recording medium transported in the horizontal direction, and the image formation is performed by jetting the liquid downward from the head. Therefore, in this type of image forming apparatus, a casing extending in the transport direction of the recording medium along a horizontal plane is often adopted. Although the apparatus having such a casing is stably installed, the apparatus has a problem such that an installation area is large. In view of this, in order to reduce the installation area, there has been also suggested an image forming apparatus in which the transport direction of the recording medium extends in a vertical direction to perform the image formation with respect to the recording medium transported in the vertical direction. In particular, the recording medium is transported in the vertical direction, and the nozzle formation surface parallel to the vertical plane is provided in the head to face the recording medium. The plurality of nozzles are formed in the nozzle formation surface in a state of being aligned in the vertical direction. The image formation on the recording medium is performed as follows. That is, the liquid droplets are jetted from the nozzles with respect to the recording medium transported in the vertical direction while the head is reciprocated in the horizontal direction (width direction of the recording medium). In the apparatus having such a construction, it is possible to reduce the installation area by reducing the width of the casing or the dimension in a depth direction.

However, since the plurality of nozzles are aligned in the vertical direction, the nozzles have positions in a height direction different from one another. In this case, the liquid is less likely to be supplied as the position of the nozzle is higher due to the influence of the water head difference, and a size of each of the liquid droplets jetted tends to decrease gradually. In a case that the difference between the size of the liquid droplet jetted from the uppermost nozzle and the size of the liquid droplet jetted from the lowermost nozzle is large in one head, there is fear that unevenness in concentration is caused in the formed image and the image is deteriorated.

In order to address the problem as described above, Japanese Patent Application laid-open No. 2002-205389 has suggested a printing apparatus having a construction described below. That is, the printing apparatus includes a head of serial type (serial type head), which faces a transport route of a recording medium having difference in height and performs image recording while scanning in the horizontal direction. In the printing apparatus, transport of the recording medium is controlled such that an image area formed by liquid droplets jetted from the nozzles, of the nozzles aligned in the vertical direction of the head, disposed on an upper half portion and an image area formed by liquid droplets jetted from the nozzles, of the nozzles aligned in the vertical direction of the head, disposed on a lower half portion are substantially overlapped with each other, and the head is driven to form a desired image by overlapping the two image areas. In particular, at first, the liquid droplets are jetted from the nozzles, of the nozzles aligned in the vertical direction, disposed on the lower half portion, during one scanning of the head. In this situation, the head jets the liquid droplets on every other pixel with respect to the scanning direction. Thereafter, the recording medium is transported so that the nozzles disposed on the upper half portion face the recording medium at positions at which the liquid droplets jetted from the nozzles disposed on the lower half portion have been landed. Then, the liquid droplets are jetted from the nozzles disposed on the upper half portion onto the recording medium at positions interposed between pixels formed by the liquid droplets jetted from the nozzles disposed on the lower half portion.

However, since influences of the difference in height of nozzles disposed on the lower half portion and the difference in height of nozzles disposed on the upper half portion are not considered in the method described in Japanese Patent Application laid-open No. 2002-205389, unevenness in concentration is caused.

In view of the above problem, an object of the present teaching is to suppress generation of unevenness in concentration and deterioration in image quality in an image forming apparatus provided with a head, in which a plurality of nozzles are formed to have positions in a height direction different from one another.

SUMMARY OF THE INVENTION

According to an aspect of the present teaching, there is provided an image forming apparatus configured to form an image on a recording medium by jetting liquid droplets of a liquid to land on the recording medium, the apparatus including: a transport section including a first transport section configured to transport the recording medium in a first direction having a component of a downward direction in a vertical direction, a second transport section configured to transport the recording medium in a second direction having a component of an upward direction in the vertical direction, and a third transport section configured to connect the first transport section and the second transport section; a first head provided to face the first transport section and including a plurality of first nozzles formed in different positions in the vertical direction; a second head provided to face the second transport section and including a plurality of second nozzles formed in different positions in the vertical direction; and a control device configured to control the transport section, the first head, and the second head, wherein the first head includes a first overlap nozzle group formed of the first nozzles arranged in an area in the vertical direction which has an upper end at a position of an uppermost second nozzle of the second nozzles and a lower end at a position of a lowermost second nozzle of the second nozzles; the second head includes a second overlap nozzle group formed of the second nozzles arranged in an area in the vertical direction which has an upper end at a position of an uppermost first nozzle of the first nozzles and a lower end at a position of a lowermost first nozzle of the first nozzles; and the control device is configured to control the transport section, the first head, and the second head so that the liquid droplets jetted from the second overlap nozzle group are landed, on the recording medium, in an area in which the liquid droplets jetted from the first overlap nozzle group have been landed.

According to the aspect of the present teaching, with respect to the liquid droplets jetted from the first overlap nozzle group and the liquid droplets jetted from the second overlap nozzle group, difference in sizes of liquid droplets is counteracted in an image forming area, and thereby reducing unevenness in concentration in an entire area in which printing is performed.

DESCRIPTION OF THE PREFERRED EMBODIMENTS

Figure 1:
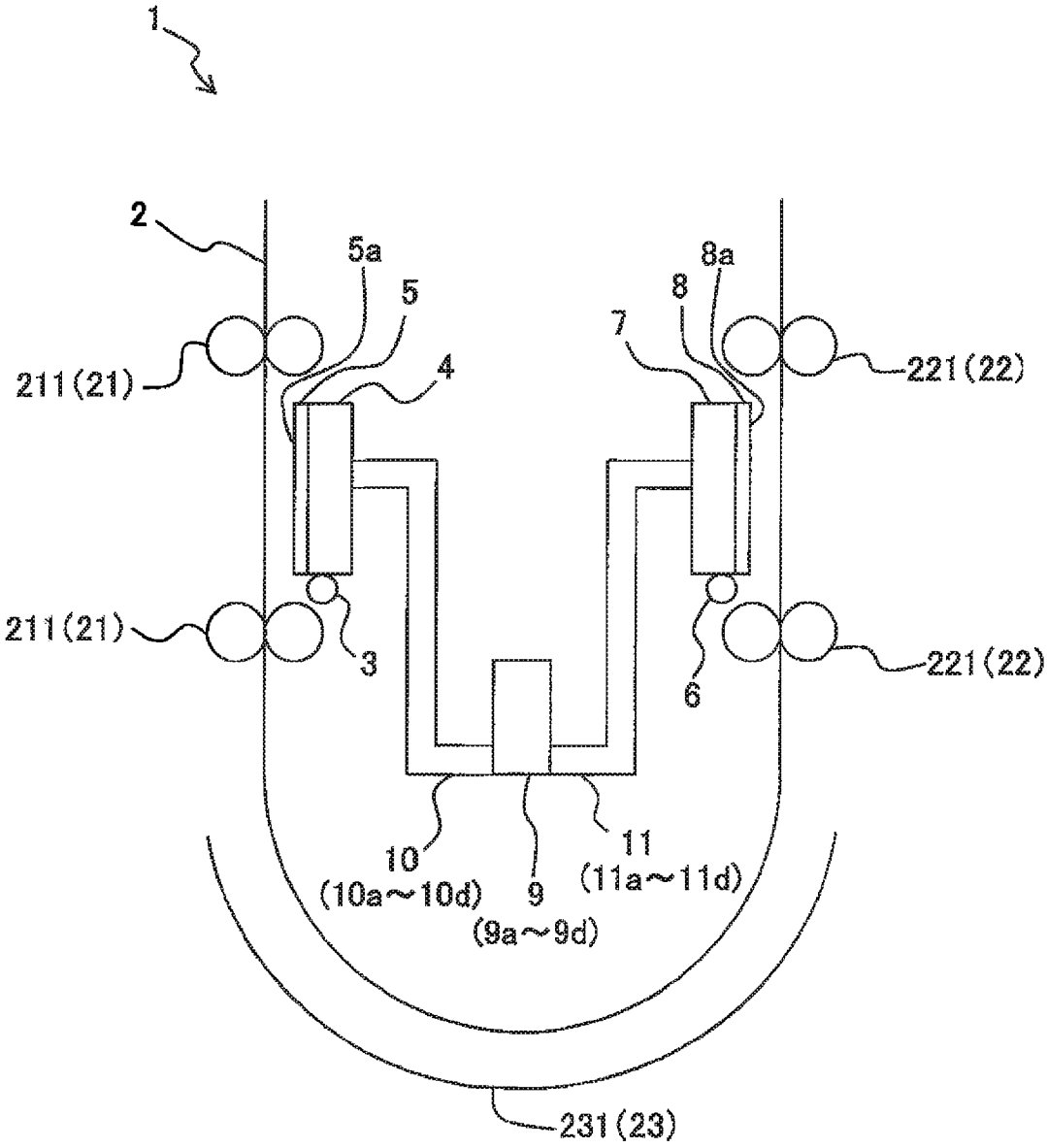
FIG. 1 is a side view of main components of an ink-jet printer according to an embodiment.
Figure 2:
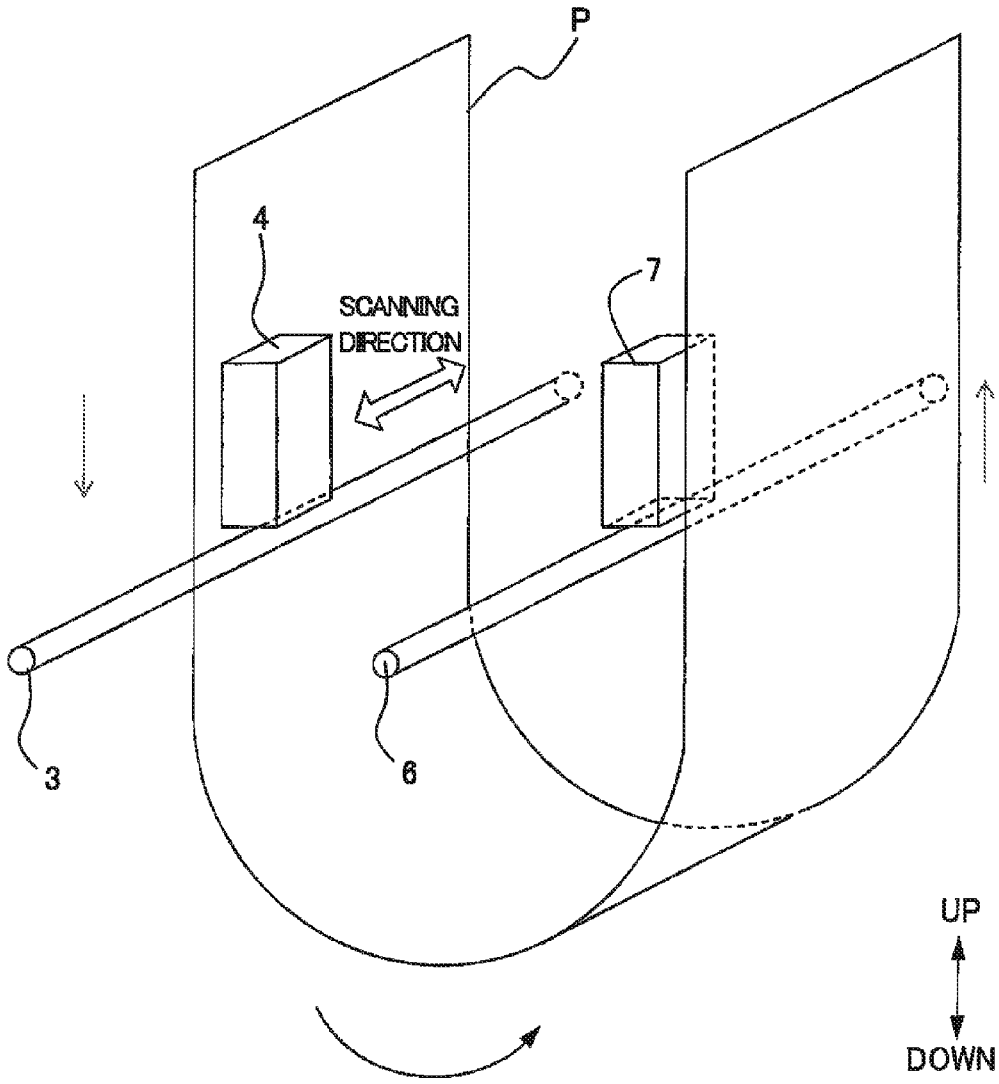
FIG. 2 is a perspective view of the main components of the ink jet printer according to the embodiment.

An explanation will be made about an embodiment of the present teaching with reference to FIG. 1 to FIG. 6.

An ink-jet printer 1 of the present teaching mainly includes a first head 5 which jets ink, a second head 8 which jets the ink, a transport route section 2 which transports a recording paper sheet P to positions facing the first head 5 and the second head 8, and a control device 100 which controls jetting of the ink from the first head 5 and the second head 8 and transport of the paper sheet P by the transport route section 2. The transport route section 2 transports the paper sheet P to a position facing the first head 5. The first head 5 jets the ink onto the paper sheet P in a state of facing the paper sheet P. Then, the transport route section 2 transports the paper sheet P to a position facing the second head 8. The second head 8 jets the ink onto the paper sheet P in a state of facing the paper sheet P. Accordingly, an image is formed on the paper sheet P.

The transport route section 2 includes a first transport section 21 which transports the paper sheet P downwardly in a vertical direction, a second transport section 22 which transports the paper sheet P upwardly in the vertical direction, and a third transport section 23 which transports the paper sheet P from the first transport section 21 to the second transport section 22. The paper sheet P transported downward from the first transport section 21 is reversed upward by the third transport section 23, and then is transported upward to the second transport section 22. Thus, the paper sheet P is transported by the first transport section 21, the third transport section 23, and the second transport section 22 in this order.

The first transport section 21 includes a pair of first transport rollers 211. In the pair of first transport rollers 211, two rollers having parallel rotary shafts are disposed to be adjacent to each other in a horizontal direction. A gap between the two rollers has a width for the paper sheet P to pass. In a case that the rollers are rotated in a state that the rollers make contact with the paper sheet P, the paper sheet P is transported in a rotation direction of the rollers by a frictional force between the rollers and the paper sheet P. In this embodiment, two pairs of first transport rollers 211 are provided on an upstream side and a downstream side in a transport direction of the paper sheet (paper transport direction).

The second transport section 22 includes a pair of second transport rollers 221. In the pair of second transport rollers 221, two rollers having parallel rotary shafts are disposed to be adjacent to each other in the horizontal direction. A gap between the two rollers has a width for the paper sheet P to pass. In a case that the rollers are rotated in a state that the rollers make contact with the paper sheet P, the paper sheet P is transported in a rotation direction of the rollers by a frictional force between the rollers and the paper sheet P. In this embodiment, two pairs of second transport rollers 221 are provided on an upstream side and a downstream side in the paper transport direction.

The third transport section 23 includes a guide member 231 formed as a U-shaped wall. The guide member 231 is provided at a position at which the paper sheet P transported by the first transport section 21 is capable of making contact with the guide member 231. In a case that the paper sheet P transported by the first transport section 21 makes contact with the guide member 231, the paper sheet P is transported to the second transport section 22 along the U-shaped wall of the guide member 231. That is, the paper transport direction after the paper sheet P is transported to the third transport section 23 is a direction opposite to the paper transport direction before the paper sheet P is transported to the third transport section 23.

The ink-jet printer 1 further includes a first carriage 4 which carries the first head 5 and a second carriage 7 which carries the second head 8.

The first carriage 4 is provided in a first support shaft 3, which is provided in a scanning direction perpendicular to the paper transport direction, to be capable of reciprocating along the first support shaft 3. The first head 5 is carried on the first carriage 4 so that a nozzle formation surface 5*a*, of the first head 5, in which a plurality of nozzles 51 (first nozzles 51) are formed faces the paper sheet P transported by the first transport section 21. The first carriage 4 and the first head 5 are arranged in an area which is above the third transport section 23 and is interposed between the first transport section 21 and the second transport section 22.

The second carriage 7 is provided in a second support shaft 6, which is provided in the scanning direction perpendicular to the paper transport direction, to be capable of reciprocating along the second support shaft 6. The second head 8 is carried on the second carriage 7 so that a nozzle formation surface 8*a*, of the second head 8, in which a plurality of nozzles 81 (second nozzles 81) are formed faces the paper sheet P transported by the second transport section 22. The second carriage 7 and the second head 8 are arranged in an area which is above the third transport section 23 and is interposed between the first transport section 21 and the second transport section 22.

The ink-jet printer 1 further includes an ink tank 9 storing the ink and ink tubes 10. 11 which are routes for supplying the ink stored in the ink tank 9 to the first head 5 and the second head 8 respectively.

The ink tank 9 includes a black ink tank 9*a* storing a black ink, a cyan ink tank 9*b* storing a cyan ink, a magenta ink tank 9*c* storing a magenta ink, and a yellow ink tank 9*d* storing a yellow ink. Each of the ink tanks 9*a* to 9*d* is disposed so that the liquid surface of the ink in each of the ink tanks 9*a* to 9*d* has a height which is lower than the lowermost nozzle 51 of the nozzles 51 formed in the first head 5 and the lowermost nozzle 81 of the nozzles 81 formed in the second head 8.

Each of the ink tubes 10, 11 is formed in a hollow shape by using a waterproof flexible material such as rubber. One end of the ink tube 10 is connected to the ink tank 9 and the other end of the ink tube 10 is connected to the first head 5. In particular, the ink tubes 10*a*, 10*b*, 10*c*, 10*d* are respectively connected to the ink tanks 9*a*, 9*b*, 9*c*, 9*d*, each of which corresponds to one of colors. The inks stored in the ink tanks 9*a* to 9*d* are supplied to the first head 5 via the ink tubes 10*a* to 10*d*, respectively. Similar to the ink tube 10, one end of the ink tube 11 is connected to the ink tank 9 and the other end of the ink tube 11 is connected to the second head 8. In particular, the ink tubes 11*a*, 11*b*, 11*c*, 11*d* are respectively connected to the ink tanks 9*a*, 9*b*, 9*c*, 9*d*, each of which corresponds to one of colors. The inks stored in the ink tanks 9*a* to 9*d* are supplied to the second head 8 via the ink tubes 11*a* to 11*d*, respectively. Further, when the first carriage 4 reciprocates, a positional relation between the first head 5 and the ink tank 9 is changed. However, the ink tube 10 is flexible, and is configured so that connection between the first head 5 and the ink tank 9 via the ink tube 10 is not broken, even when the positional relation between the first head 5 and the ink tank 9 is changed. The ink tube 11 has the same structure as the ink tube 10, and connection between the second head 8 and the ink tank 9 via the ink tube 11 is not broken, even when the positional relation between the second head 8 and the ink tank 9 is changed.

Next, an explanation will be made about the first head 5. In the first head 5, the plurality of nozzles 51 through which the ink is jetted are formed. The first head 5 is carried on the first carriage 4 so that the nozzle formation surface 5*a* in which the nozzles 51 are formed is positioned vertically. Further, the nozzle formation surface 5*a* faces the paper sheet P transported by the first transport section 21 so that the nozzle formation surface 5*a* is parallel to the paper sheet P.

The plurality of nozzles 51 include nozzles 51*a*, nozzles 51*b*, nozzles 51*c*, and nozzles 51*d*. The inks of black, cyan, magenta, and yellow are jetted from the nozzles 51*a*, the nozzles 51*b*, the nozzles 51*c*, and the nozzles 51*d*, respectively. Each of the nozzles 51*a*, the nozzles 51*b*, the nozzles 51*c*, and the nozzles 51*d* are 8 nozzles, and nozzles from which the ink of the same color is jetted are aligned in a straight line in the vertical direction. Further, nozzles from which inks of different colors are jetted are arranged in positions different in the horizontal direction. In other words, an arrangement direction of the nozzles 51 from which the ink of the same color is jetted is the vertical direction perpendicular to the scanning direction of the first carriage 4.

Here, the positional relation between the ink tank 9 and the first head 5 will be explained. The ink tank 9 is disposed to be positioned below the first head 5. Since the liquid surface of the ink in the ink tank 9 is positioned below the first head 5, negative pressure is applied to the ink in each of the nozzles 51 due to difference between the position of the liquid surface of the ink in the ink tank 9 and the position of the liquid surface of the ink in the first head 5 (water head difference). This prevents the ink from leaking from each of the nozzles 51 during a period of time in which the image formation is not performed.

However, the nozzles 51 provided for the first head 5 are disposed in the vertical direction, and the nozzles 51 have positions different from one another in the vertical direction. Therefore, the difference between the position of the liquid surface of the ink tank 9 and the position of the liquid surface of each nozzle 51 varies among the nozzles 51. Here, it is assumed that printing gradation is ignored and that the pressure applied to the ink from the head at the time of jetting the ink from each of the nozzles 51 is the same, the pressure to jet the ink varies, in the nozzles 51 having different height positions, in an amount corresponding to the difference between the position of the liquid surface of the ink tank 9 and the position of the liquid surface of each nozzle 51 (water head difference). Since different pressures to jet the ink are applied to the nozzles 51, liquid droplets of the ink having different sizes are jetted from the nozzles 51 disposed at different height positions. In particular, the size of each of the liquid droplets is smaller, as the position of the nozzle 51, from which the liquid droplets are jetted, in the vertical direction is higher, and the size of each of the liquid droplets is larger, as the position of the nozzle 51, from which the liquid droplets are jetted, in the vertical direction is lower. Next, an explanation will be made about the second head 8.

In the second head 8, the plurality of nozzles 81 through which the ink is jetted are formed. The second head 8 is carried on the second carriage 7 so that a nozzle formation surface 8*a* in which the nozzles 81 are formed is positioned vertically. Further, the nozzle formation surface 8*a* faces the paper sheet P transported by the second transport section 22 so that the nozzle formation surface 8*a* is parallel to the paper sheet P. The plurality of nozzles 81 include nozzles 81*a*, nozzles 81*b*, nozzles 81*c*, and nozzles 81*d*. The inks of black, cyan, magenta, and yellow are jetted from the nozzles 81*a*, the nozzles 81*b*, the nozzles 81*c*, and the nozzles 81*d*, respectively. Each of the nozzles 81*a*, the nozzles 81*b*, the nozzles 81*c*, and the nozzles 81*d* are 8 nozzles, and nozzles from which the ink of the same color is jetted are aligned in a straight line in the vertical direction. Further, nozzles from which inks of different colors are jetted are arranged in positions different in the horizontal direction. In other words, an arrangement direction of the nozzles 81 from which the ink of the same color is jetted is the vertical direction perpendicular to the scanning direction of the second carriage 7.

The positional relation between the ink tank 9 and the second head 8 is similar to the positional relation between the ink tank 9 and the first head 5, and thus a phenomenon similar to the case of the first head 5 is occurred. That is, also with respect to the second head 8, the size of each of the liquid droplets is smaller, as the position of the nozzle 81, from which the liquid droplets are jetted, in the vertical direction is higher, and the size of each of the liquid droplets is larger, as the position of the nozzle 81, from which the liquid droplets are jetted, in the vertical direction is lower.

In the ink-jet printer 1 of this embodiment, the second head 8 has the same structure as that of the first head 5, and a diameter and an arrangement of the nozzles of the second head 8 are the same as those of the first head 5. Further, the first head 5 and the second head 8 are disposed so that the first head 5 has the position in the vertical direction which is the same as that of the second head 8 and so that inclination of the nozzle formation surface 5*a* with respect to the vertical direction is identical to inclination of the nozzle formation surface 8*a* with respect to the vertical direction. Thus, the n-th nozzle from the lowermost nozzle in the first head 5 has the position in the vertical direction which is the same as that of the n-th nozzle from the lowermost nozzle in the second bead 8. That is, in this embodiment, all of the nozzles 51 in the first head 5 are arranged in an area in the vertical direction in which the position of the lowermost nozzle 81 in the second head 8 is regarded as a lower end and the position of the uppermost nozzle 81 in the second head 8 is regarded as an upper end. On the other hand, all of the nozzles 81 in the second head 8 are arranged in an area in the vertical direction in which the position of the lowermost nozzle 51 in the first head 5 is regarded as a lower end and the position of the uppermost nozzle 51 in the first head 5 is regarded as an upper end. Since the liquid droplets jetted from the nozzles having the same position in the vertical direction have the same size, the size of each of the liquid droplets jetted from the n-th nozzle from the lowermost nozzle in the first head 5 is identical to the size of each of the liquid droplets jetted from the n-th nozzle from the lowermost nozzle in the second head 8.

Figure 3:
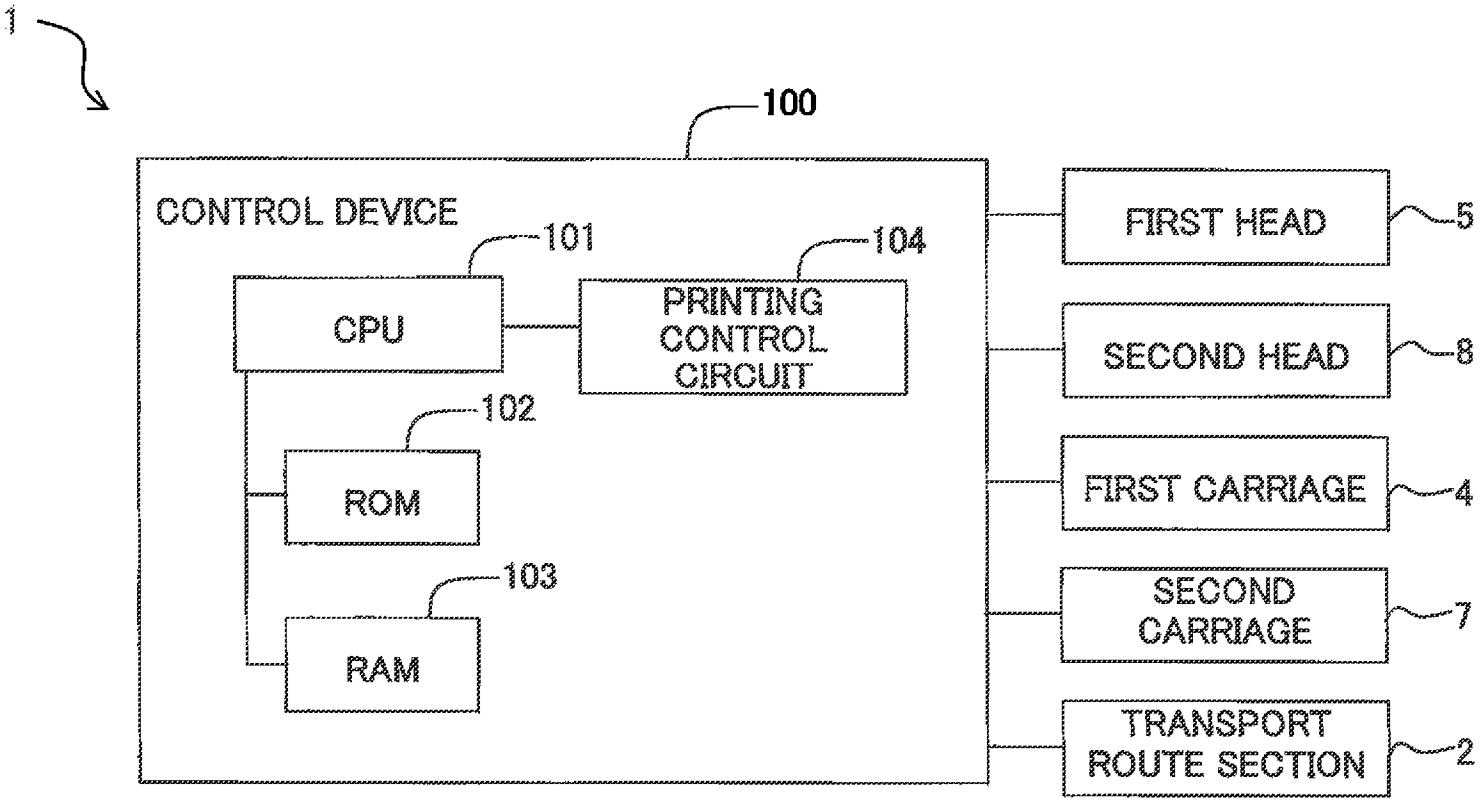
FIG. 3 is a schematic block diagram of the ink-jet printer according to the embodiment.
Figure 4:
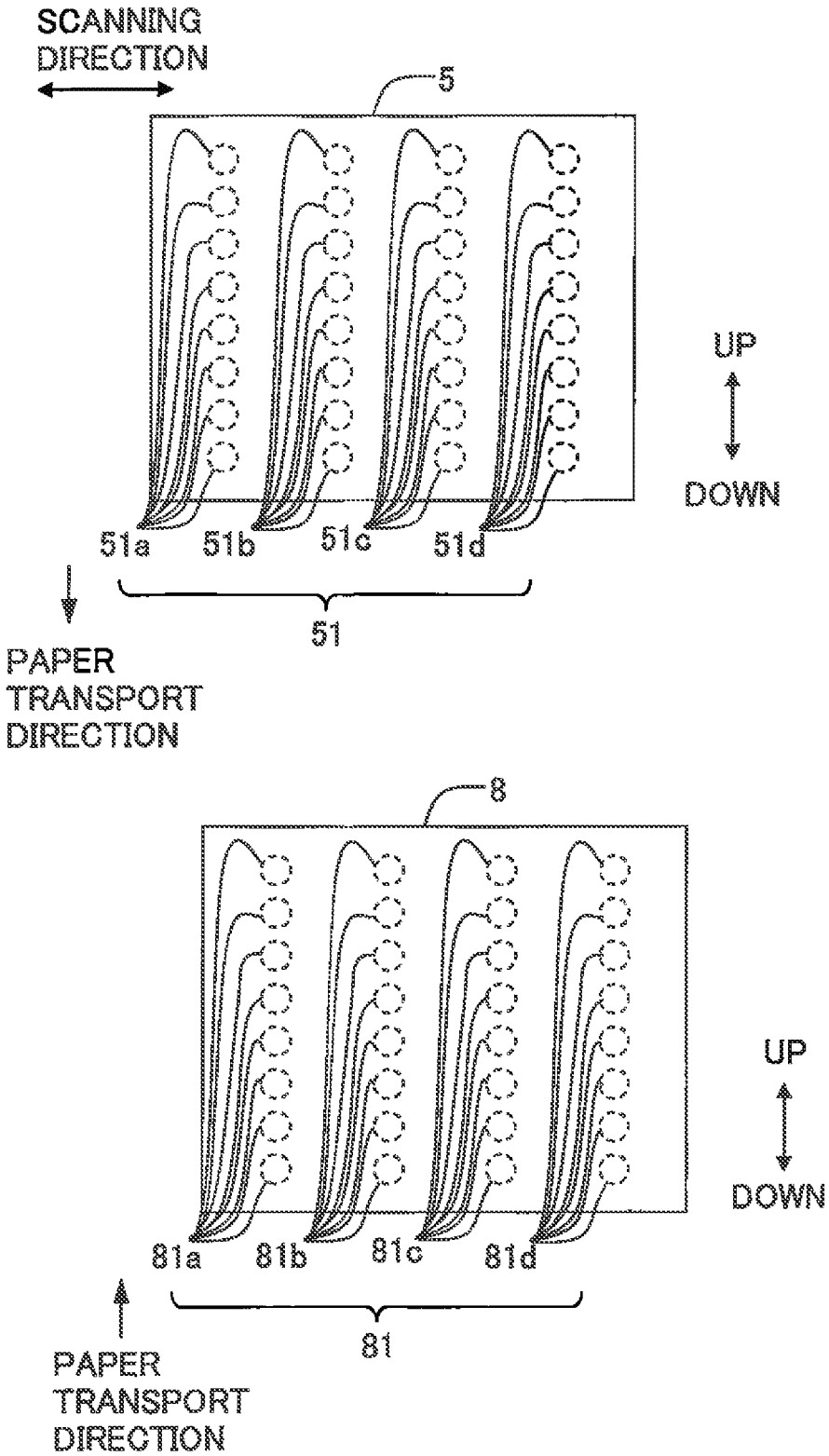
FIG. 4 is a plan view showing a first head and a second head according to the embodiment.

Next, an explanation will be made about an electric configuration of the ink-jet printer 1 of the present teaching. As shown in FIG. 3, the control device 100 includes a microcomputer, which includes a Central Processing Unit (CPU) 101, a Read Only Memory (ROM) 102 in which various programs, data, and the like for controlling the overall operation of the ink-jet printer 1 are stored, a Random Access Memory (RAM) 103 in which data and the like processed by the CPU 101 are temporarily stored, and a printing control circuit 104 for controlling each structure (component) of the ink-jet printer 1.

In particular, the printing control circuit 104 included in the control device 100 controls the first head 5, the second head 8, the first carriage 4, the second carriage 7, the transport route section 2, and the like to perform printing operation to the paper sheet P. The printing control circuit 104 controls each component of the ink-jet printer 1 based on printing data inputted from an unillustrated external device connected to the ink-jet printer 1 to make the ink-jet printer 1 perform the printing operation described below. That is, the printing control circuit 104 controls the first head 5 to jet the ink from the nozzles 51 of the first head 5 onto the paper sheet P while moving the first carriage 4 in the scanning direction. Along with this, the printing control circuit 104 controls the transport route section 2 to transport the paper sheet P in the transport direction. Then, after the paper sheet P is transported to the position facing the second head 8, the printing control circuit 104 controls the second head 8 to jet the ink from the nozzles 81 of the second head 8 onto the paper sheet P while moving the second carriage 7 in the scanning direction. In accordance with the operation as described above, a desired pattern such as the image and/or letters is printed on the paper sheet P.

Figure 5:
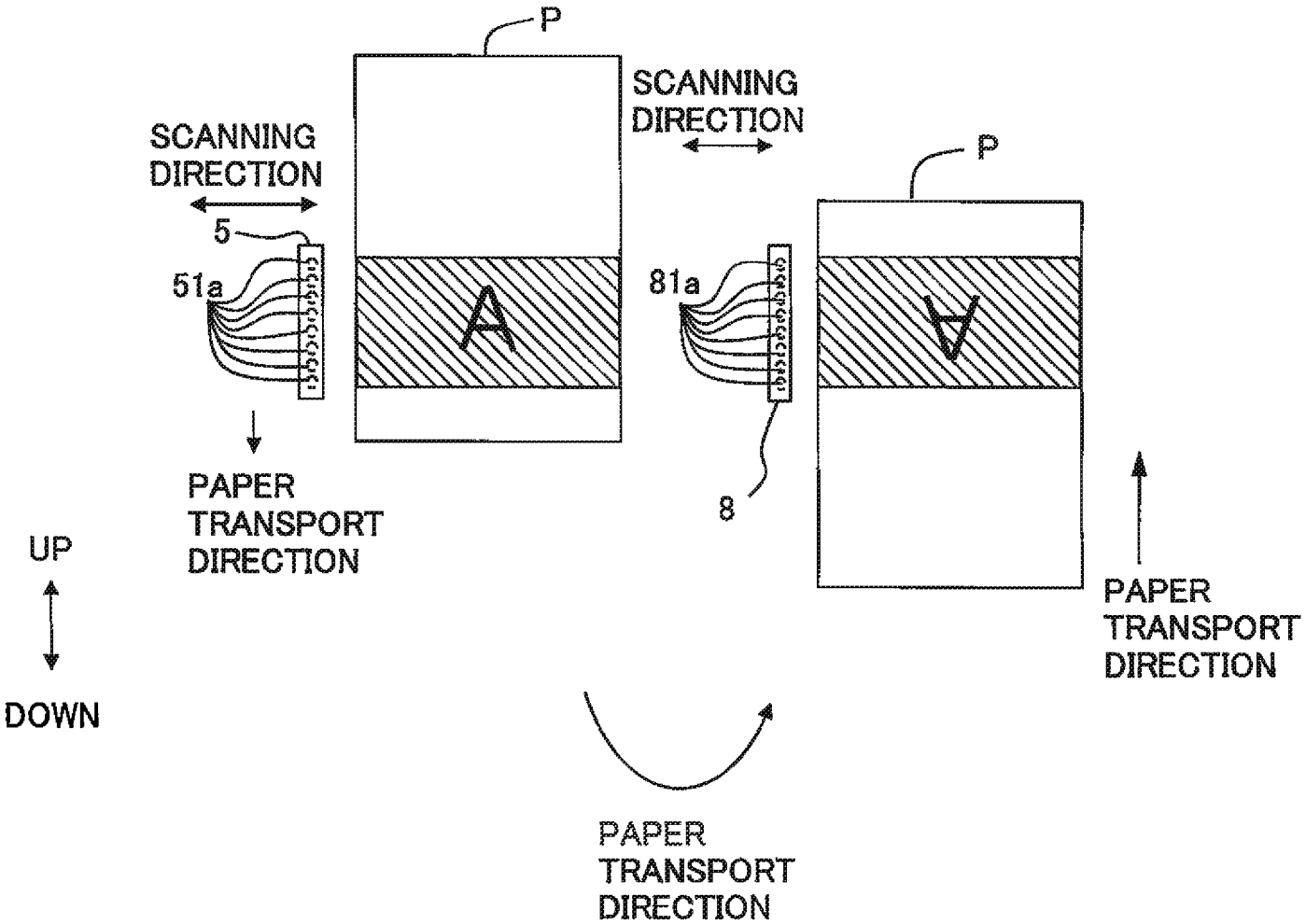
FIG. 5 is a diagram showing a relation between a paper transport direction and the first head and a relation between the paper transport direction and the second head according to the embodiment.
Figure 6A:
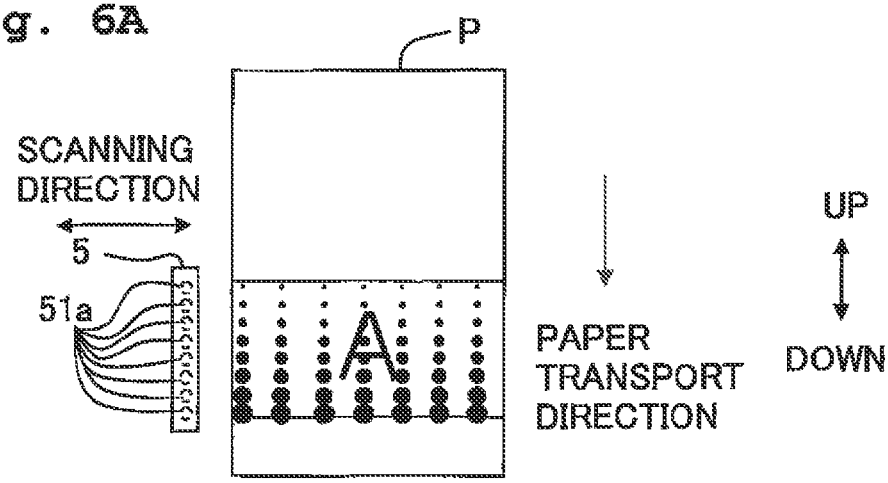
FIGS. 6A to 6C are diagrams each showing a positional relation in a paper sheet between dots formed by liquid droplets jetted from the first head and dots formed by liquid droplets jetted from the second head.
Figure 6B:
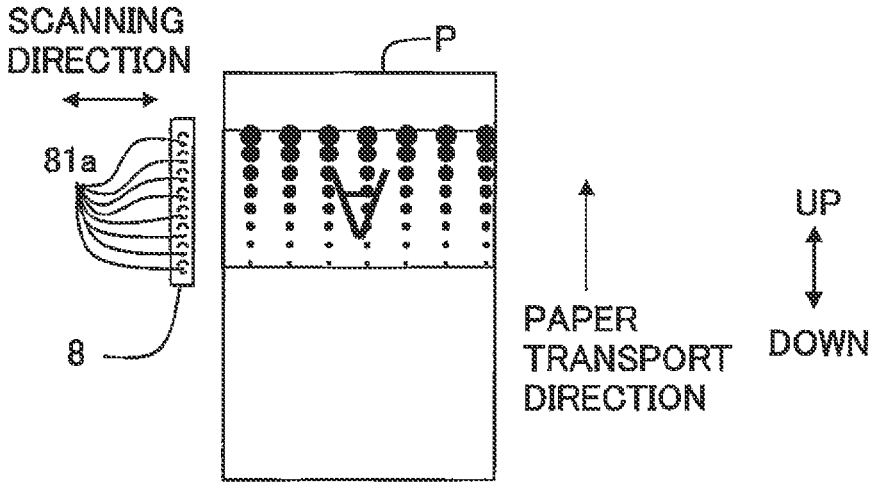
Figure 6C:
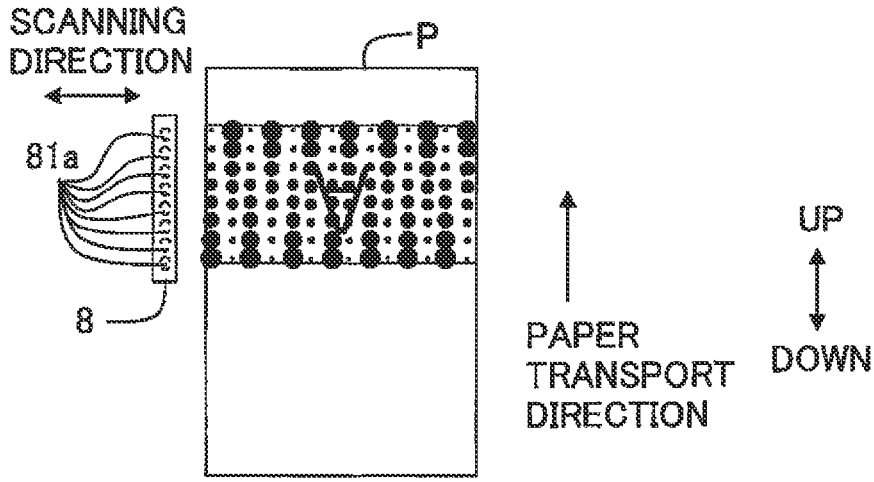

Next, an explanation will be made in detail about printing operation of the present teaching with reference to FIG. 5 to FIG. 6C. In the first head 5, the nozzles 51*a* are aligned in the vertical direction. The nozzles 51*b*, 51*c*, and 51*d* are omitted in FIG. 5 to FIG. 6C. In the second head 8, the nozzles 81*a* are aligned in the vertical direction in a similar manner to the first head 5. The nozzles 81*b*, 81*c*, and 81*d* are omitted in FIG. 5 to FIG. 6C. As described above, the nozzles 51*a* the nozzle 81*a*) have different positions in the vertical direction, and the nozzle shown on the lower side in FIG. 5 is positioned on the lower side in the vertical direction.

As described above, the printing operation of the present teaching is performed in the following order. That is, the ink is jetted from the first head 5 in a state that the paper sheet P is transported to the position facing the first head 5, and then the ink is jetted from the second head 8 in a state that the paper sheet P is transported to the position facing the second head 8. In a case that the printing is performed by the first head 5, the paper transport direction is a downward direction; and in a case that the printing is performed by the second head 8, the paper transport direction is an upward direction.

Here, an explanation will be made about printing operation for forming the image in an area A of the paper sheet P.

At first, the control device 100 drives the pair of first transport rollers 211 to transport the paper sheet P to a position facing the first head 5. In this situation, the paper transport direction is the downward direction. Then, the control device 100 moves the first carriage 4 in the scanning direction and drives the first head 5 to jet the ink therefrom. Accordingly, the ink is jetted from the first head 5 at the position facing the paper sheet P along with movement of the first carriage 4 in the scanning direction, and thereby liquid droplets are landed on the paper sheet P. Here, the area in which the liquid droplets are landed during one scanning of the first carriage 4 is assumed to be the area A.

The liquid droplets jetted from the first head 5 have different sizes depending on positions in the vertical direction of the nozzles 51. As shown in FIG. 6A, the size of each of the liquid droplets is larger, as the position in the vertical direction of the nozzle from which the liquid droplets are jetted is lower.

Next, the control device 100 drives the pair of first transport rollers 211 to transport the paper sheet P to the third transport section 23. In the third transport section 23, the paper sheet P is transported along the guide member 231 while being brought in contact with the guide member 231 having the U-shape as whole. Thus, although the paper transport direction at the time at which the paper sheet P is transported from the first transport section 21 to the third transport section 23 is the downward direction, the paper transport direction at the time at which the paper sheet P is transported from the third transport section 23 to the second transport section 22 is changed to the upward direction.

When the paper sheet P is further transported to arrive at the pair of second transport rollers 221, the control device 100 drives the pair of second transport rollers 221 to transport the paper sheet P to a position at which the area A of the paper sheet P faces the second head 8. In this situation, the paper transport direction is the upward direction. That is, the arrangement of the area A at the time of performing the printing by the second head 8 is opposite to the arrangement of the area A at the time of performing the printing by the first head 5 in the vertical direction. Then, the control device 100 drives the second head 8 to jet the ink therefrom while moving the second carriage 7 in the scanning direction. Accordingly, the ink is jetted from the second head 8 at the position facing the paper sheet P along with the movement of the second carriage 7 in the scanning direction, and thereby liquid droplets are landed on the paper sheet P. The control device 100 controls the second head 8 and the pair of second transport rollers 221 so that the liquid droplets jetted from the second head 8 are landed in the area overlapping with the area A.

As described above, the printing is performed in the area A by the second head 8 after the printing is performed in the area A by the first head 5. Further, the arrangement position of the area A at the time of the printing by the first head 5 is opposite to the arrangement position of the area A at the time of the printing by the second head 8 in the up-down direction. That is, as shown in FIG. 6C, in the area A, dots printed by the nozzles 51 disposed on the upper side of the first head 5 are aligned with dots printed by the nozzles 81 disposed on the lower side of the second head 8 in the scanning direction, and dots printed by the nozzles 51 disposed on the lower side of the first head 5 are aligned with dots printed by the nozzles 81 disposed on the upper side of the second head 8 in the scanning direction.

Accordingly, the liquid droplets, each of which has a relatively small size and is jetted from the nozzles 51 disposed on the upper side of the first head 5, and the liquid droplets, each of which has a relatively large size and is jetted from the nozzles 81 disposed on the lower side of the second head 8, are landed on the same area. Similarly, the liquid droplets, each of which has a relatively large size and is jetted from the nozzles 51 disposed on the lower side of the first head 5, and the liquid droplets, each of which has a relatively small size and is jetted from the nozzles 81 disposed on the upper side of the second head 8, are landed on the same area. Thus, the sum (total) of the sizes of the liquid droplets jetted from the first head 5 and the sizes of the liquid droplets jetted from the second head 8 is the same in two positions each having the same distance in the paper transport direction from a midpoint of the area A in the paper transport direction. Also in two positions having distances different from each other in the paper transport direction from the midpoint of the area A in the paper transport direction, the difference in the total of the sizes of the liquid droplets jetted from the first head 5 and the sizes of the liquid droplets jetted from the second head 8 is small. Therefore, it is possible to reduce the unevenness in concentration in the entire area A.

Next, an explanation will be made in detail about landing of the liquid droplets of the ink in the area A with reference to FIGS. 6A to 6C. In FIGS. 6A to 6C, dots formed on the paper sheet P by landing the liquid droplets are schematically shown by black dots. The sizes of the black dots schematically show the sizes of the dots formed on the paper sheet P. That is, the black dots each having the large size show the dots formed by liquid droplets each having the large size.

At first, the control device 100 controls the first head 5 and the first carriage 4 so that the liquid droplets jetted from the first head 5 during one scanning of the first carriage 4 are landed in the area A. In this situation, as shown in FIG. 6A, the dot formed by each of the liquid droplets of the ink landed on the paper sheet P is smaller, as the landing position of the dot is the upper side. Next, the control device 100 controls the pair of first transport rollers 211 and the pair of second transport rollers 221 to reverse the paper sheet P as shown in FIG. 6B, and transports the paper sheet P to the scanning area of the second head 8. In this situation, since the paper sheet P is reversed, the dot having the large size, of the dots formed such that the liquid droplets are jetted from the first head 5 to be landed on the paper sheet P, is positioned on the upper side and the dot having the small size is positioned on the lower side.

Then, the control device 100 controls the second head 8 and the second carriage 7 so that the liquid droplets jetted from the second head 8 during one scanning of the second carriage 7 are landed in the area A. The liquid droplets are jetted from the second head 8 to be landed alternately with the liquid droplets jetted from the first head 5 with respect to the scanning direction perpendicular to the paper transport direction. By landing the liquid droplets jetted from the second head 8 alternately with the liquid droplets jetted from the first head 5 with respect to the scanning direction, as shown in FIG. 6C, each dot having the large size and each dot having the small size are alternately formed to be adjacent to each other in the scanning direction. Therefore, as compared with a case in which the dots each having the large size and/or the dots each having the small size are successively arranged in the scanning direction, it is possible to reduce the unevenness in concentration.

Figure 7A:
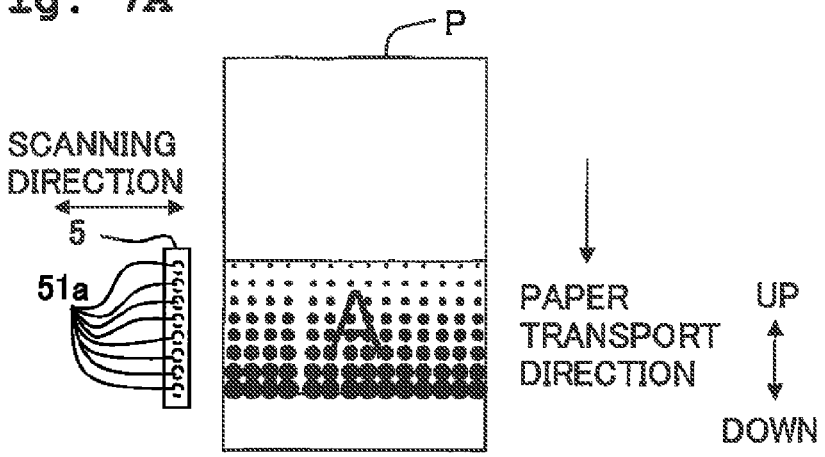
FIGS. 7A to 7C are diagrams respectively corresponding to FIGS. 6A to 6C in the first modified embodiment.
Figure 7B:
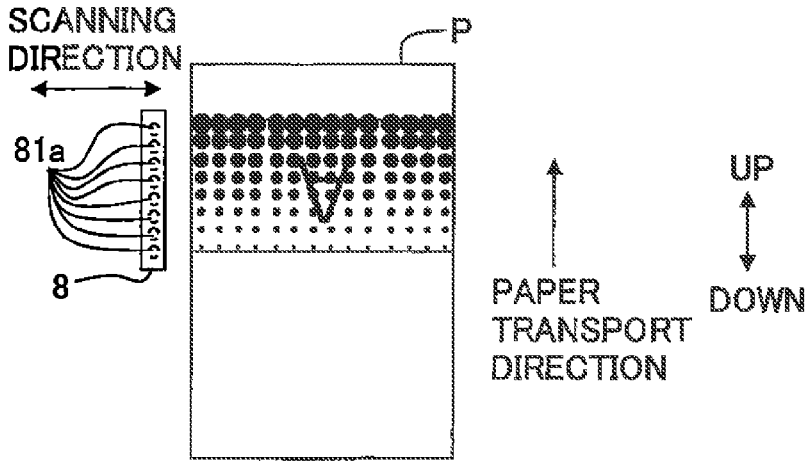
Figure 7C:
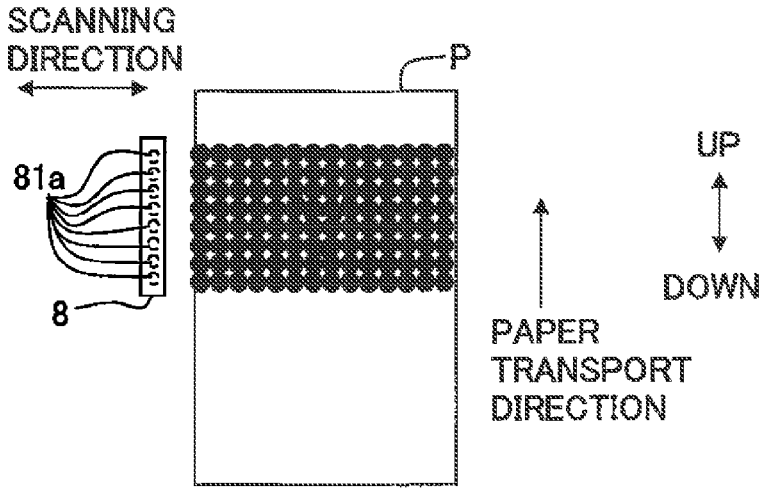

Next, an explanation will be made about a modified embodiment in which various modifications are added to the above embodiment. In the embodiment as described above, the liquid droplets are jetted from the second head 8 to be landed alternately with the liquid droplets jetted from the first head 5 with respect to a direction perpendicular to the transport direction of the paper sheet P, that is, the scanning direction. However, a relation between positions at which the liquid droplets of the ink jetted from the first head 5 are landed and positions at which the liquid droplets of the ink jetted from the second head 8 are landed is not limited thereto. For example, as shown in FIGS. 7A to 7C, the second head 8 may be driven so that each liquid droplet jetted from the second head 8 is landed at a position overlapping with the position at which each liquid droplet jetted from the first head 5 is landed (first modified embodiment). In this case, the liquid droplets can be landed so that imbalance in the sizes of the liquid droplets of the ink jetted from the first head 5 and imbalance in the sizes of the liquid droplets jetted from the second head 8 are counteracted with each other. Accordingly, printing quality is improved.

Figure 8:
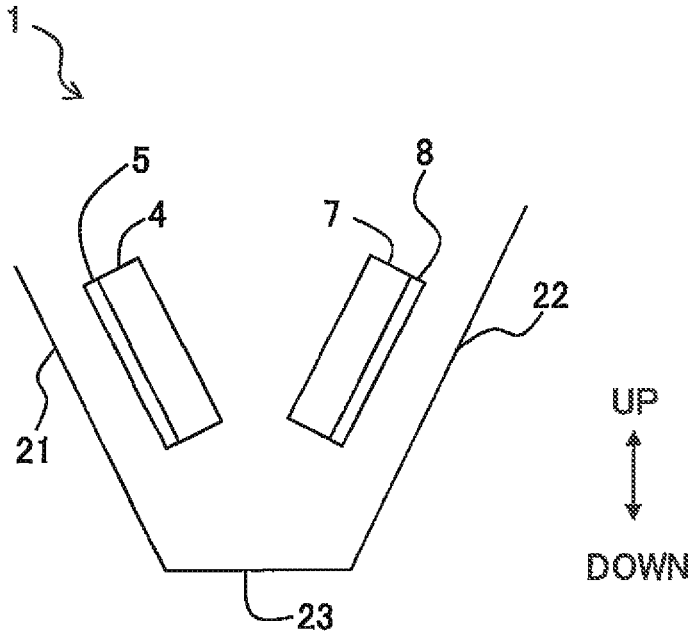
FIG. 8 is a diagram showing an arrangement relation between the paper sheet and the first head and an arrangement relation between the paper sheet and the second head in the second modified embodiment, and shows a state in which the paper sheet, nozzle surfaces of the first head and the second head are inclined with respect to a vertical direction.

In the embodiment described above, the nozzle formation surface 5*a* of the first head 5 and the nozzle formation surface 8*a* of the second head 8 are disposed vertically to jet the liquid droplets in the horizontal direction. However, the arrangement angle of each of the first head 5 and the second head 8 is not limited thereto. For example, as shown in FIG. 8, the ink-jet printer 1 may be configured so that the nozzle formation surface 5*a* of the first head 5 and the nozzle formation surface 8*a* of the second head 8 are each disposed at an angle inclined with respect to the vertical direction to jet the liquid droplets at an angle inclined with respect to the horizontal direction (second modified embodiment). In the modified embodiment as shown in FIG. 8, the angle of the nozzle formation surface 5*a* of the first head 5 in the vertical direction is equal to the angle of the nozzle formation surface 8*a* of the second head 8 in the vertical direction. Therefore, a position of each of the nozzles 51 of the first head 5 in the vertical direction is identical to a position of each of the nozzles 81 of the second head 8 in the vertical direction. Further, the nozzle formation surface 5*a* of the first head 5 is parallel to a portion of the transport route section 2 facing the nozzle formation surface 5*a*, and the nozzle formation surface 8*a* of the second head 8 is parallel to a portion of the transport route section 2 facing the nozzle formation surface 8*a*.

Figure 9:
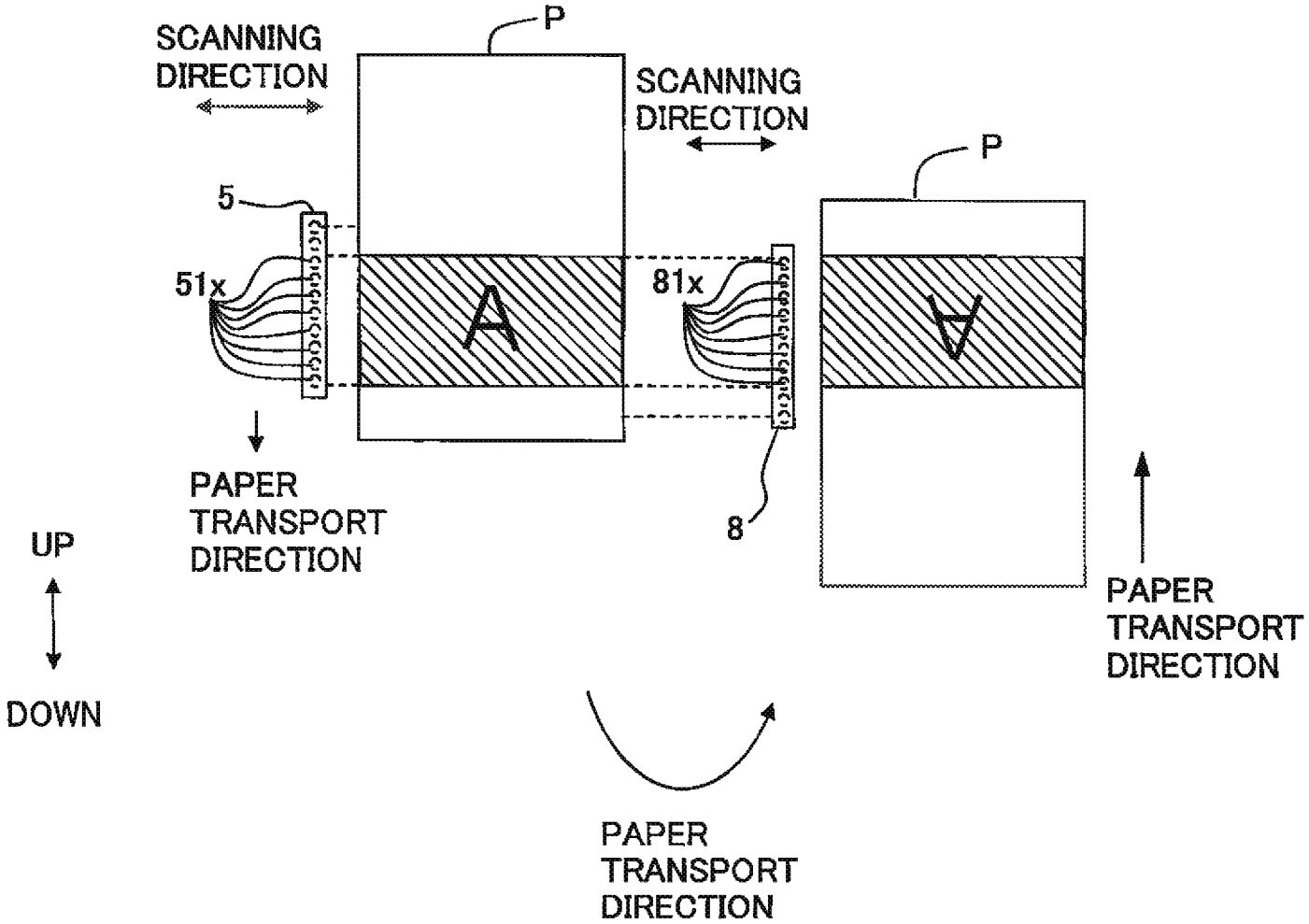
FIG. 9 is a diagram corresponding to FIG. 5 in the third modified embodiment.

Further, in the embodiment as described above, the first head 5 has the same structure as the second head 8, the number of nozzles of the first head 5 is the same as that of the second head 8, and each interval between nozzles adjacent to each other in the first head 5 is the same as that in the second head 8. However, the number of nozzles of the first head 5 may be different from that of the second head 8, and each interval between the nozzles adjacent to each other in the first head 5 may be different from that in the second head 8. For example, as shown in FIG. 9, the first head 5 may include a first overlap nozzle group 51*x* formed of the nozzles 51 disposed at an area in the vertical direction in which the position of the uppermost nozzle 81 in the second head 8 is regarded as an upper end and the position of the lowermost nozzle 81 in the second head 8 is regarded as a lower end, and the second head 8 may include a second overlap nozzle group 81*x* formed of the nozzles 81 disposed at an area in the vertical direction in which the position of the uppermost nozzle 51 in the first head 5 is regarded as an upper end and the position of the lowermost nozzle 51 in the first head 5 is regarded as a lower end (modified embodiment 3). The liquid droplets jetted from the second overlap nozzle group 81*x* may be landed in an area in which the liquid droplets jetted from the first overlap nozzle group 51*x* are landed. Also in this case, it is possible to reduce unevenness in printing.

Figure 10:
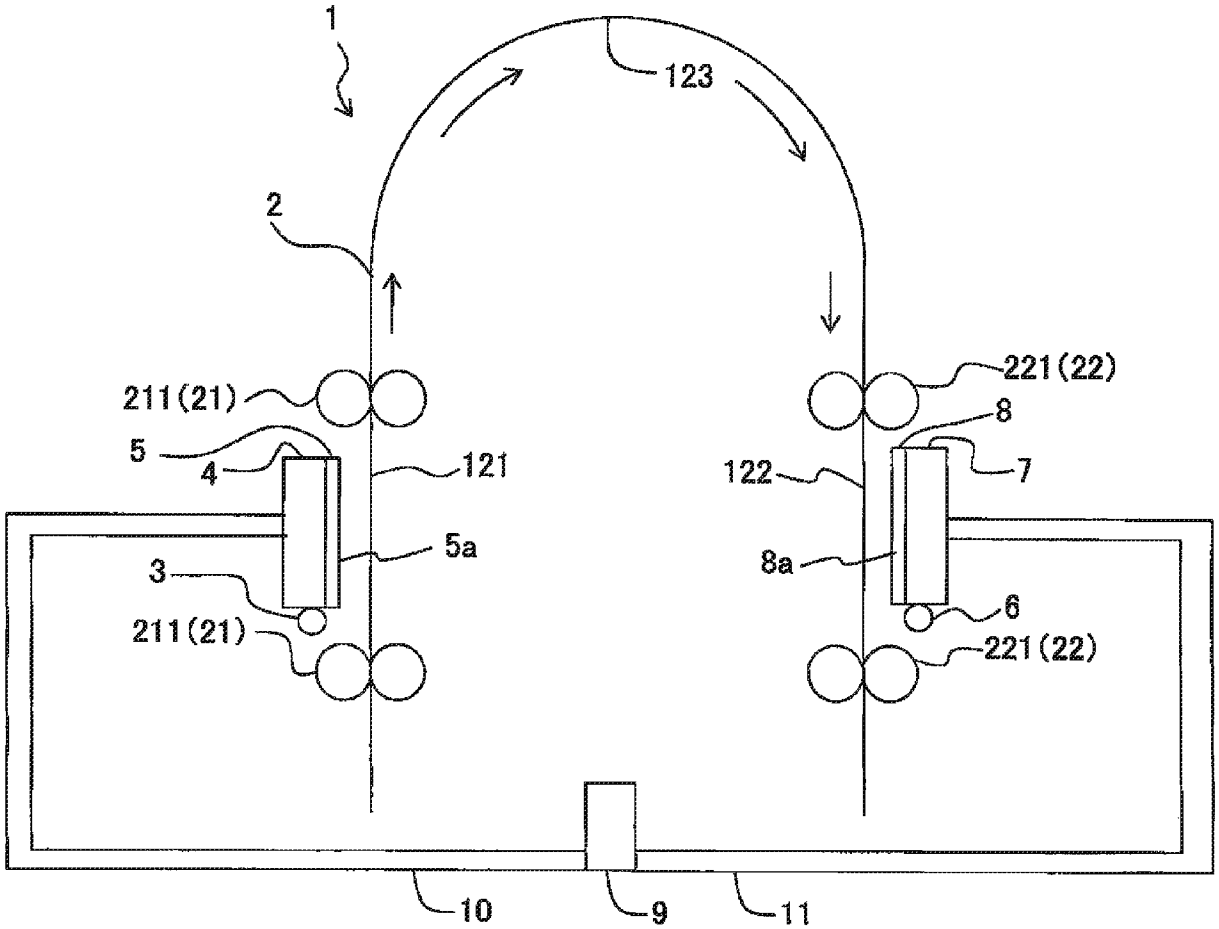
FIG. 10 is a diagram corresponding to FIG. 1 in the fourth modified embodiment.

In the embodiment described above, the first head 5 and the second head 8 are arranged at a position interposed between the first transport section 21 and the second transport section 22. According to this structure, it is possible to reduce the whole size of the ink-jet printer 1. However, the position at which the first head 5 and the second head 8 are arranged is not limited thereto. For example, as shown in FIG. 10, the first head 5 and the second head 8 may be provided on the outer sides of the transport route section 2 (fourth modified embodiment). In particular, the transport route section 2 may be formed of a first transport section 121 which transports the paper sheet P upwardly in the vertical direction, a second transport section 122 which transports the paper sheet P downwardly in the vertical direction, and a third transport section 123 which transports the paper sheet P from the first transport section 121 to the second transport section 122. Then, the transport route section 2 may be arranged to be interposed between the first head 5 and the second head 8. In this case, the third transport section 123 includes a guide member having the U-shape arranged in a direction opposite to the guide member in the embodiment as described above (i.e. the curved portion is disposed on the upper side). The paper sheet P is transported along outer surfaces of the first transport section 121, the third transport section 123, and the second transport section 122 in this order.

In the embodiment described above, the first carriage 4 and the second carriage 7 can be driven so that the movement direction of the first carriage 4 with respect to the scanning direction is opposite to the movement direction of the second carriage 7 with respect to the scanning direction. In this case, vibrations caused by the movement of the respective carriages are counteracted with each other. Thus, it is possible to suppress position deviations of the first head 5, the second head 8, and the paper sheet P due to the vibrations, and thereby the liquid droplets can be landed on appropriate positions in the paper sheet P. However, the movement direction of the first carriage 4 with respect to the scanning direction may not be opposite to the movement direction of the second carriage 7 with respect to the scanning direction. For example, it can be configured so that the movement of the first carriage 4 in the scanning direction and the movement of the second carriage 7 in the scanning direction are performed at the same time in the same direction. In this case, the first carriage 4 and the second carriage 7 can be configured as one carriage by connecting them to each other.

In the embodiment described above, in the position facing the first head 5 and the position facing the second head 8, the transport route section 2 extends in the vertical direction. However, the structure of the transport route section 2 is not limited thereto. For example, the transport route section 2 may be configured so that the paper sheet P is transported at an angle inclined with respect to the vertical direction in the position facing the first head 5 and the position facing the second head 8.

Figure 11:
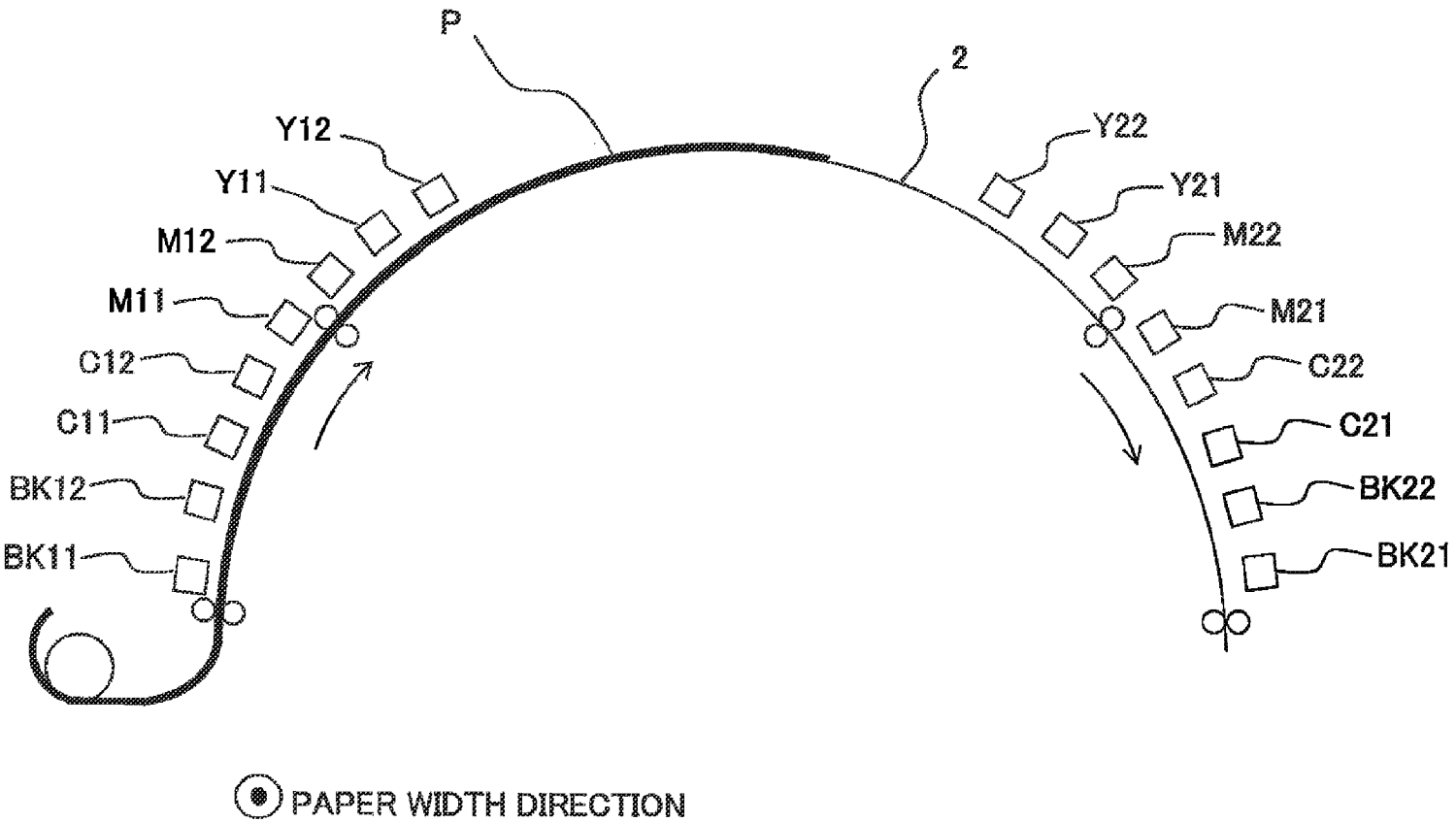
FIG. 11 is a diagram corresponding to FIG. 1 in the fifth modified embodiment.

Although the first head 5 and the second head 8 in the embodiment described above are so-called ink-jet heads of serial type in which the first head 5 and the second head 8 are respectively carried on the first carriage 4 and the second carriage 7 to reciprocate in the scanning direction, the first head 5 and the second head 8 in the embodiment described above may be so-called ink-jet heads of line type, each of which includes a nozzle row formed over a range which is not less than a width of the paper sheet P and jets the ink in a state of being fixed with respect to the transport route section 2. In this case, as shown in FIG. 11, a plurality of line heads (for example, BK11 and BK12) for jetting the ink of the same color may be fixed with respect to the transport route section 2 to be adjacent to each other. In this case, one nozzle row extending in a direction perpendicular to the paper transport direction (width direction of the paper sheet P) may be formed in each of the line heads BK11 to Y22. A plurality of nozzle rows may be formed along the paper transport direction in each of the line heads (fifth modified embodiment).

In the embodiment as described above, each of the ink tanks 9*a* to 9*d* is disposed on the position lower than positions of the first head 5 and the second head 8. However, the positional relations between each of the ink tanks 9*a* to 9*d* and the first head 5 in the vertical direction and between each of the ink tanks 9*a* to 9*d* and the second head 8 in the vertical direction are not limited thereto. For example, each of the ink tanks 9*a* to 9*d*, the first head 5, and the second head 8 may be arranged at the same position in the vertical direction, and each of the ink tanks 9*a* to 9*d* may be disposed at a position higher than positions of the first head 5 and the second head 8.

What is claimed is:

1. An image forming apparatus configured to form an image on a recording medium by jetting liquid droplets of a liquid to hind on the recording medium, the apparatus comprising:

a transport section including:

a first transport section configured to transport the recording medium in a first direction having a first vertical component;

a second transport section configured to transport the recording medium in a second direction having a second vertical component opposite to the first vertical component of the first direction; and a third transport section configured to connect the first transport section and the second transport section;

a first head comprising a first line head and a second line head, which are fixed at different positions with respect to a vertical direction to face the first transport section, each of which extends in a third direction perpendicular to the first direction and the second direction and each of which includes a plurality of first nozzles aligned in the third direction;

a second head comprising a third line head and a fourth line head, which are fixed at the same positions as the first line head and the second line head respectively with respect to the vertical direction to face the second transport section, each of which extends in the third direction, and each of which includes a plurality of second nozzles aligned in the third direction; and a control device configured to control the transport section, the first head, and the second head;

wherein the first head includes a first overlap nozzle group formed of the first nozzles arranged in an area in the vertical direction which has an upper end at a position of an uppermost second nozzle of the second nozzles and a lower end at a position of a lowermost second nozzle of the second nozzles;

wherein the second head includes a second overlap nozzle group formed of the second nozzles arranged in an area in the vertical direction which has an upper end at a position of an uppermost first nozzle of the first nozzles and a lower end at a position of a lowermost first nozzle of the first nozzles; and wherein the control device is configured to control the transport section, the first head, and the second head so that the liquid droplets jetted from the second overlap nozzle group are landed, on the recording medium, in an area in which the liquid droplets jetted from the first overlap nozzle group have been landed.

2. The image forming apparatus according to claim 1;

wherein the first head and the second head are disposed to sandwich the first transport section and the second transport section therebetween.

3. The image forming apparatus according to claim 1;

wherein the image forming apparatus includes at least one of a structure in which the first overlap nozzle group is formed of all of the first nozzles and a structure in the second overlap nozzle group is formed of all of the second nozzles.

4. The image forming apparatus according to claim 3;

wherein the first overlap nozzle group is formed of all of the first nozzles and the second overlap nozzle group is formed of all of the second nozzles.

5. The image forming apparatus according to claim 4;

wherein the first head has the same structure as the second head.

6. The image forming apparatus according to claim 1;

wherein an angle of a nozzle formation surface of the, first line head in which the first nozzles are formed is identical to an angle of a nozzle formation surface of the third line head in which the second nozzles are formed, with respect to a vertical plane including a component of a width direction of the recording medium transported by the transport section; and wherein an angle of a nozzle formation surface of the second line head in which the first nozzles are formed is identical to an angle of a nozzle formation surface face of the fourth line head in which the second nozzles are formed, with respect to the vertical plane.

7. The image forming apparatus according to claim 1;

wherein the control device is configured to control the transport section, the first head, and the second head so that the liquid droplets jetted from the second head are landed, on the recording medium, alternately with the liquid droplets jetted from the first head in the third direction.

8. The image forming apparatus according to claim 1;

wherein the control device is configured to control the transport section, the first head, and the second head so that the liquid droplets jetted from the second head are landed, on the recording medium, at positions at which the liquid droplets jetted from the first head have been landed, respectively.

9. The image forming apparatus according to claim 1, further comprising:

a liquid tank storing the liquid to be supplied to the first head and the second head;

wherein the liquid tank is arranged at a position lower than a lower end of the first head and a lower end of the second head in the vertical direction.

* * * * *

UNITED STATES PATENT AND TRADEMARK OFFICE

CERTIFICATE OF CORRECTION

PATENT NO. : 8,757,770 B2
APPLICATION NO. : 13/759145
DATED : June 24, 2014
INVENTOR(S) : Yusuke Suzuki et al.

It is certified that error appears in the above-identified patent and that said Letters Patent is hereby corrected as shown below:

In the Claims:

At column 13, claim number 3, lines 30-31,

--"formed of all of the first nozzles and a structure in the second overlap"-- should read --"formed of all of the first nozzles and a structure in which the second overlap"--

Signed and Sealed this
Twenty-fifth Day of November, 2014

Michelle K. Lee

Michelle K. Lee
*Deputy Director of the United States Patent and Trademark Office*